US005930848A

United States Patent [19]

Last

[11] Patent Number: 5,930,848

[45] Date of Patent: Aug. 3, 1999

[54] MANUAL COVER DRIVE FOR SWIMMING POOLS

[76] Inventor: Harry J. Last, 122 Dunecrest Ave., Monterey, Calif. 93940

[21] Appl. No.: 09/063,095

[22] Filed: Apr. 14, 1998

Related U.S. Application Data

[63] Continuation of application No. 08/520,406, Aug. 29, 1995.

[51] Int. Cl.[6] ..... E04H 4/10

[52] U.S. Cl. ..... 4/502

[58] Field of Search ..... 4/498, 502

[56] References Cited

U.S. PATENT DOCUMENTS

| | | | |
|---|---|---|---|
| 2,754,900 | 7/1956 | Karobonik et al. | 4/502 X |
| 2,958,083 | 11/1960 | Shook et al. | 4/502 |
| 3,019,450 | 2/1962 | Karasiewicz | 4/502 |
| 3,050,743 | 8/1962 | Lamb | 4/502 |
| 3,613,126 | 10/1971 | Granderath | 4/502 |
| 3,982,286 | 9/1976 | Foster | 4/502 |
| 4,939,798 | 7/1990 | Last | 4/502 |
| 5,067,184 | 11/1991 | Last | 4/502 |
| 5,184,357 | 2/1993 | Last | 4/502 |
| 5,327,590 | 7/1994 | Last | 4/502 |
| 5,349,707 | 9/1994 | Last | 4/502 |

*Primary Examiner*—Robert M. Fetsuga
*Attorney, Agent, or Firm*—Robert J. Schaap

[57] ABSTRACT

A manually powered swimming pool cover drive for extending and retracting swimming pool covers and which includes a pair of overrunning one way clutch devices for intermittent coupled rotation with and also freewheeling about a drive shaft. A drum rotates with the drive shaft and allows winding of a cover about the drum when retracted from a covered position over a swimming pool. A pair of one way clutches may be trained around a drive shaft and coupled for rotating a cable reel allowing for the winding of cables used to extend a swimming pool cover. The respective pairs of overrunning, one-way clutches are reciprocated back and forth respectively in a type of indexing operation, manually and with long lever handles for rotating the drive shafts.

41 Claims, 10 Drawing Sheets

30
29
26
12
28
10
9
25
24

10
9
30
29
36

12
28
39
37
24
10-b
9

22
15a
11
19
22
15a
9
19

Fig.2
Fig.2(a)
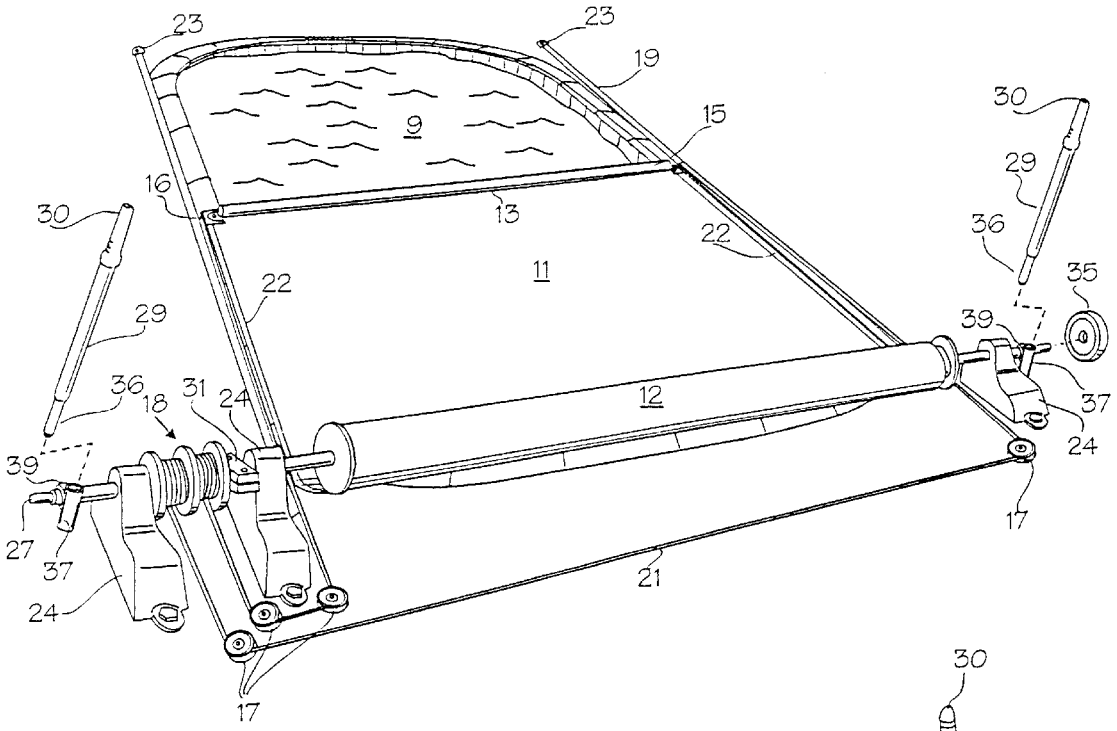
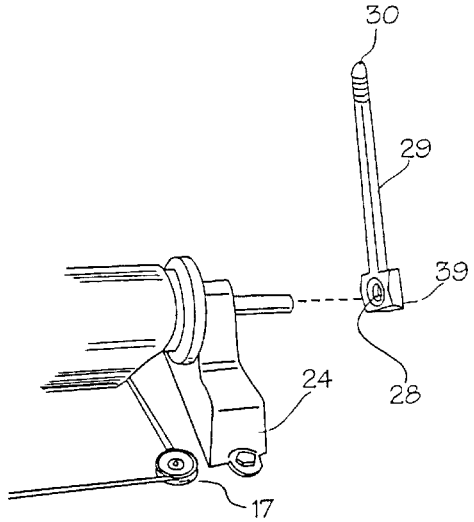
Fig.2(b)

9
10
11
12
13
15
18
19
24
27
31
32
33
34
35
39a
39b
39c
39d
45

Fig.6
Prior Art
Classic One Way Clutch Mechanism
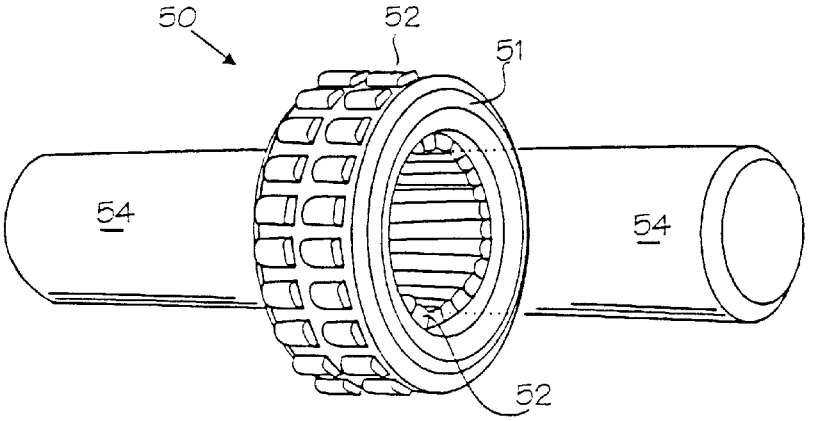
Fig.6(a)
DRIVING
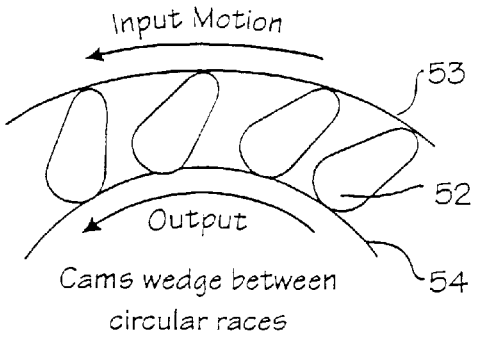
Fig.6(b)
FREEWHEELING
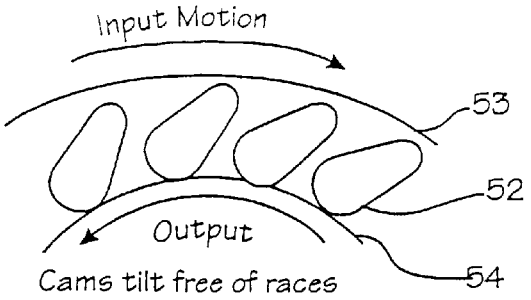
Fig.6(c)

Classic One Way Clutch Mechanism

Fig.10
Fig.10(a)
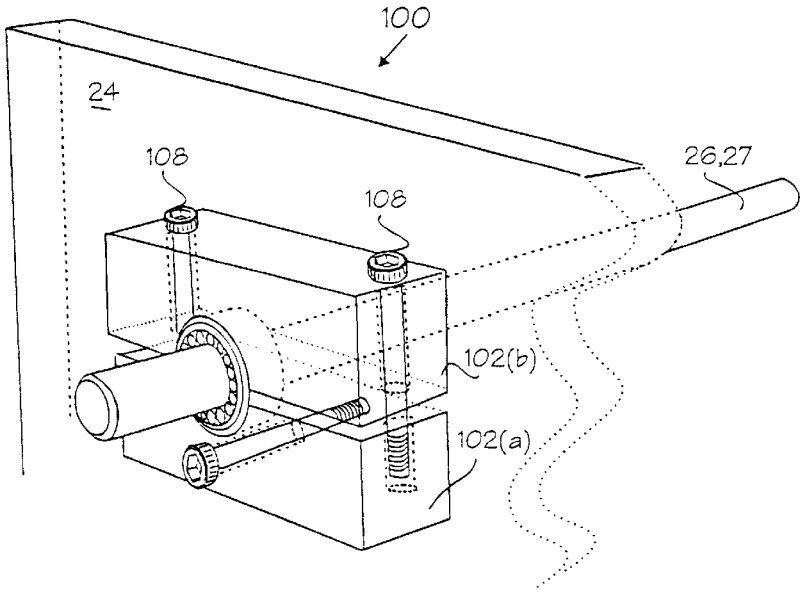
Fig.10(b)
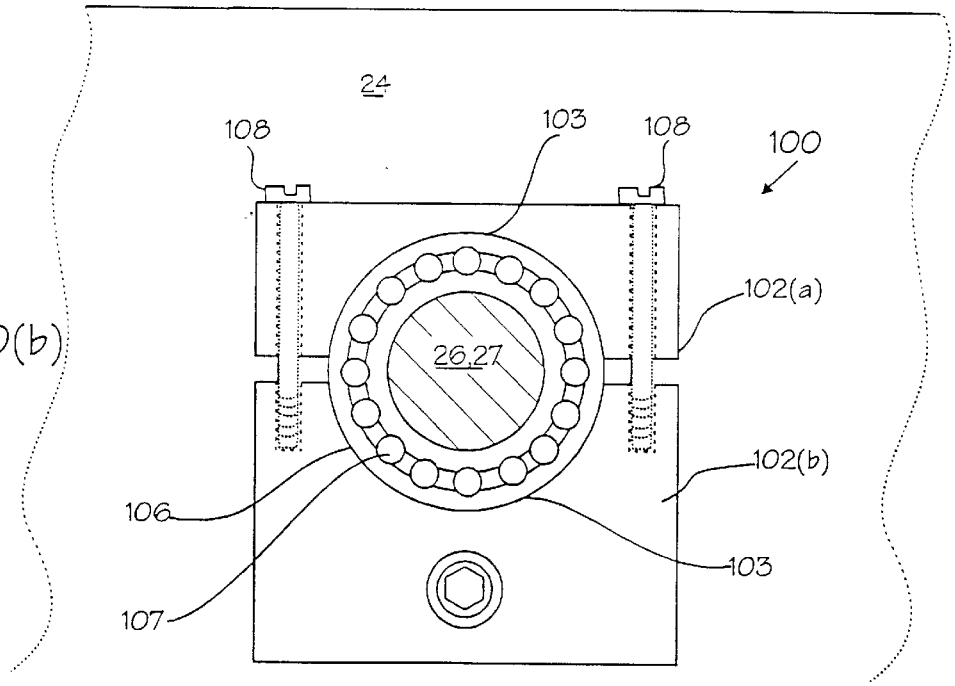

MANUAL COVER DRIVE FOR SWIMMING POOLS

RELATED APPLICATION

This application is a continuation of my co-pending U.S. patent application Ser. No. 08/520,406, filed Aug. 29, 1995.

BACKGROUND OF THE INVENTION

1. Field of the Invention

The invention relates to swimming pool cover systems and, in particular, to a drive utilizing a manually powered overrunning, one way clutch for alternatively rotating a cover drum and cable reel for retracting and extending a pool cover across a swimming pool.

2. Description of the Prior Art

Pool covers are used on many swimming pools. They save energy, keep the pool clean, minimize chemical use and provide desirable safety features. In fact, in windy locations, a pool cover is essential for maintaining pool water at comfortable temperatures at a reasonable expense.

The types of pool covering systems generally available commercially include free floating covers, tie down/stretched covers and track anchored floating covers. Mechanisms for retracting such covers back and forth across a pool include purely manual devices such as the "Rocky's" roller manufactured B. C. Leisure Ltd. 113-1305 Welch Street North Vancouver B.C. Canada V7P 1B3; semi-automatic systems (see U.S. Pat. No. 4,351,072) and automatic systems, which are usually electrically or hydraulically powered. (See U.S. Pat. Nos. 2,754,899; 2,958,083; 3,019,450; 3,050,743; 3,613,126; 3,982,286; 4,939,798 and 5,327,590).

Un-anchored floating pool covers typically serve as heat conservation blankets. Such floating blankets present a deceptive drowning hazard, particularly to young children and animals who often perceive the floating surface as being capable of providing support. Instead, the cover collapses, enfolds and entraps as the unlucky person, or animal sinks below the water surface. To alleviate such hazard, pools covered with un-anchored floating covers should be fenced and locked up when not in use, i.e., be treated as uncovered pool. Cover anchoring systems having separate fasteners for securing the perimeter of such floating covers to the pool deck are used in some cases to prevent a floating cover from enfolding and entrapping an inadvertent, unwary person or animal. However, such fastening systems tend to be very tedious and time consuming for properly securing a cover. Such lack of convenience lessens the likelihood of the cover being properly anchored. Improperly anchored floating covers present an even greater hazard as they reinforce an illusion of safety. Another disadvantage of floating and tie down pool cover systems is that when conditions are windy, they become extremely unruly to handle both on removal from and placement over the pool surface.

Recently, several manual pool cover systems have been marketed with typical extruded aluminum "C" channel swimming pool track for anchoring the side edges of the pool cover as is commonly done with automatic pool cover systems. The swimming pool track is secured on the pool deck along the sides of the swimming pool. The "C" channel of the track captures and holds a slidable beaded tape edge of the pool cover. The cover drum is manually rotated with a conventional crank (see the "Rocky" roller, supra) for retracting the cover from across the pool surface. However, as the cover winds onto the cover drum thereby increasing the diameter of the cover drum, the relative mechanical advantage of a crank handle turning the cover drum decreases. Accordingly, the effort required to turn the crank increases with increasing cover drum diameter. Similarly, the manual effort required to crank a cable reel for winding up a cable or line for extending a cover across a pool increases as the cover extends not only because of relative decrease in mechanical advantage of the crank, but also because of increasing friction resistance of the cover sliding in the track and across deck surface as it extends. Accordingly, such manual covers are typically extended across the pool by one preferably two or more persons pulling on ropes/cables extending from the front beaded tape edges of the cover. Such manual covers system are sometimes marketed as a temporary system which may later be stepped up to an automatic pool cover system by addition of a motor and/or cable reel system. In practice however, this rarely happens, and because of the physical effort involved, manual systems actually end up not being used once acquired.

Semi-automatic systems are only slightly more convenient than manual systems in that the cover drum is motorizing using electrical, hydraulic or spring motors for retracting the cover from across the pool. The pool covering fabric must still be pulled out manually by one or two operators and then secured by means of fasteners at the end of the pool, (and sides of the pool where track is not utilized to anchor the edges of the cover). In the case of a spring motor, in addition to overcoming the frictional load of the cover sliding in the track and across pool and deck surfaces, the operators must also wind the torsion spring of the spring motor.

Although effective and easy to use when properly maintained, some automatic pool cover systems are typically viewed and treated by consumers as troublesome contraptions prone to frequent failure. As performance degrades, frustrated pool owners sometimes overstress safety limits typically designed into such automatic motorized systems to preventing catastrophic failure. A stuck, halfway extended/retracted automatic pool cover not only causes grief for a pool owner but also for the repairman who must attempt to repair it while enduring the wrath of the pool owner. Automatic pool cover systems are also more expensive, and often beyond the means of homeowner families with toddlers.

Pool cover systems utilizing interconnected rigid buoyant slats which roll up on a submerged or elevated drum as described by U.S. Pat. No. 3,613,126, R. Granderath, popular in Europe, utilize passive forces arising from buoyancy or gravity for propelling, the cover extending it across a pool. In either instance, there must be some mechanism to prevent a retracted cover from unwinding responsive to the passive force. Such passive force systems also have a disadvantage in that the passive force must be overcome during retraction. Granderath suggests costly worm gear drive mechanisms for winding the cover and preventing cover drum rotation when not powered.

Another particular perplexing phenomenon in any coupled winding and unwinding system such as a pool cover—cable reel system, is that surface velocities of the respectively winding and unwinding elements vary as they wind and unwind from the respective rotating elements. (See Applicant's U.S. Pat. Nos. 5,184,357 & 5,327,590.) In the automatic pool cover systems of the type developed by Lamb, & McDonald (supra), bi-directional clutches of a type developed by W. W. Annable (U.S. Pat. No. 1,114,716) are used to alternatively couple a bi-directional drive motor to a cover drum when rotating one direction, and to a cable reel when rotating in the opposite direction. When not coupled to the motor by the bidirectional clutch, both the cover drum or cable reel respectively free wheel.

Creep is another phenomenon that must be addressed by any pool cover extension-retraction system. Creep results from the inherent resiliency or elasticity of the cover and cables. Such resiliency and rotational inertial of a spinning cable reel as the cover extends can cause cable backlash and snarling. In his co-pending application, Ser. No. 80/322,464 filed Oct. 14, 1994 entitled "ANTI-CAVITATION MANIFOLD FOR DRIVE COUPLED, DUAL MOTOR, REVERSIBLE HYDRAULIC DRIVE SYSTEMS" the Applicant describes a hydraulic manifold which hydraulically locks a driving hydraulic motor to inherently prevent creep from unwinding the winding element. [See Applicant's U.S. Pat. Nos. 5,184,357 & 5,327,590 describing a dual hydraulic drive system where one reversible hydraulic motor is driven as a pump to provide a resistance load on the unwinding element for tensioning the cables and cover while the other reversible hydraulic motor rotates the winding element.] In cable length, spring compensation and tensioning systems pioneered by the Applicant under U.S. Pat. No. 3,982,286, Foster, (See Applicant's U.S. Pat. Nos. 4,939,590 & 5,067,184), the inherent resiliency and elasticity of the cables and cover are effectively compensated by the tensioning of the spring. In bidirectional clutch disengagement systems of the type developed by Lamb, a brake is utilized to resist and tension the unwinding cables as the cover is wound around the cover drum to preclude backlash and recoil and snarling of the cables due to the rotational inertial of the cable reel.

Regardless of the type of system used, pool size determining size and weight of a cover sheet of slat cover also imposes physical limits. This is particularly true of fastener secured covers where heavier vinyl and other fabrics are required. It is also true of floating thermal blankets. For, example, two or more persons are typically required to remove and place pool covers larger than 16'×32'. And, where a pool is wide or non-rectangular, pulling a cover over the water and deck surfaces is both awkward and hard. And, if the wind is blowing, manually removing placing or otherwise handling an unsecured cover can be quite dangerous.

The weight of water from rain or other external source collecting on the external surface of an extended cover sliding in and anchored along the sides of a pool by swimming pool track is also a problem. In particular, as the cover retracts, external water on the cover surface initially collects proximate and then is lifted up to pour over the top of the leading edge supporting the cover end above the pool surface. Unless removed before or as the cover retracts, weight of excessive external water on the cover surface can be sufficient to tear the beaded side edges of the cover from confining track channels, and catastrophically stall most cover winding mechanisms. Even with pour over systems as describe by Foster & Last, [See U.S. Pat. Nos. 3,982,286; 4,939,798, & 5,067,184] additional torque is required of the drive system winding the cover to cause the water to pour out through the screen opening proximate the leading edge holding the cover end above the pool surface.

In instances where the cover drum and cable reel are anchored at a pool end for securing the cover, the cover drum should be close to or below the pool deck. In particular, the proximity of the cover drum surface to the track plane (the plane defined by the respective "C" channels of the swimming pool track fastened along the sides of the pool) determines the break-angle and hence frictional drag as the cover moves into out of the swimming pool track unwinding and winding around a cover drum. Also, the weight of a cover hanging from a wound up cover drum can cause it to unwind. [See R. Granderath, supra] The space between surface of an exposed cover drum with the cover unwound and the pool deck also allows wind, dirt, debris, bugs, animals and toddlers to gain access under covered pool defeating many of the advantages and reasons for a cover in the first instance. Finally, aesthetics and design considerations demanded by pool owners require that all pool cover systems regardless of type, blend and not present trip hazards when the pool is uncovered and being used.

For manually rotated cover pool systems the degree of proximity of a cover drum to the pool deck surface limits the radius of conventional crank handles or wheels used to manually rotate the cover drum. Pool owners do not tolerate scraped knuckles well. And, as a practical matter, the cover drum must be enclosed both to prevent dirt and debris from blowing into a covered pool beneath the cover drum and to alleviate a trip hazard inherently presented by above deck pool cover anchored at one end of a swimming pool. Such cover drum enclosures limit access necessary for manually cranking or rotating a cover drum.

In contrast to above deck systems, locating a cover drum of a pool cover system in an covered trough or cover trench at one end of a pool, below the pool deck has the advantage of effectively isolating the pool, when covered, from blowing dirt and debris. Also locating a pool cover drum below the pool deck surface has an advantage of allowing the top rather than the bottom circumferential surface of the drum to be positioned relative to the track plane. And, if the swimming pool tracks for anchoring the sides of the pool cover are secured beneath the undercoping, the cover drum is most practically located below the pool deck.(See Applicants U.S. Pat. No. 5,439,707) However, placing manually cranked pool cover systems in a trough below a pool deck has not heretofore been considered feasible not only because of the inherent space limitations thereby further reducing the roller crank length and leverage, but also because most pool owners will not kneel down on a pool deck and then bend over to reach down to manually crank the cover drum in a trough below the pool deck even if it were possible.

Moreover, even with existing above deck, manually rotated, pool cover systems, pool owners are required to bend over or kneel to rotate a cover drum located just above the pool deck. Such bending or kneeling positions are not suitable postures for utilizing physical body strength. Nor are such postures recommended for the type strenuous work required of a pool owner to manually rotate a cover drum for winding up a pool cover. In particular, human beings most efficiently produce and transmit power via reciprocating linear arm and leg movements, typically using alternate left and right side body movements. Mechanisms for converting of such reciprocating linear human motion or effort into rotational motion are generally well known. See, for example, as U.S. Pat. No. 4,624,962, Street, entitled "*Upper Body Exercise Mechanism*", and U.S. No. Pat. 5,139,469, Hennessey entitled "*Exercise Machine and Transmission Thereof.*"

SUMMARY OF THE INVENTION

An invented manual powered pool cover drive is described which includes at least one removable handle or lever, equipped with or coupling to an overrunning, one way clutch mechanism fitting onto or journaled around a drive shaft mechanically coupled for rotating a pool cover drum or a cable reel. When reciprocated back and forth in a power stroke and return stroke responsive to human limb (arm and/or leg) movement, the handle and overrunning clutch mechanism efficiently couple and convert human energy into power for rotating a cover drum for retracting, or, alternately, a cable reel for extending a swimming pool cover.

In the invented manual powered pool cover drive, minimum handle or lever length is determined by the mechanical advantage necessary for enabling a single person to easily overcome mechanical and friction loads resisting retraction or extension of a pool cover back and forth across a swimming pool. Above that minimum, handle length can be adjusted for operational convenience. Preferably a pair of handles or levers are removably coupled to a pair of overrunning, one way clutch mechanisms permanently journaled around a drive shaft mechanically coupled for rotating a pool cover drum or a cable reel. Alternately, each handle includes an overrunning, one way clutch mechanism at its distal end adapted to slip onto and engage a drive shaft coupled for rotating a cover drum or cable reel. The handles can also be telescoping, slide-away or fold-away. In other versions, one or two overrunning, one way clutch mechanisms are slidable axially along a pair of oppositely extending, independent coaxial drive shafts of identical diameter, one mechanically coupling to and rotating a cover drum, the other a cable reel.

A novel feature of the invented manually powered pool cover drive relates to a passive braking mechanism which includes a stationary friction housing enclosing or clamped around an outer race of an overrunning one-way clutch journaled around a cable reel or cover drum drive shaft. The overrunning one-way clutch is oriented to engage when the reel or cover drum rotates in the unwinding direction causing the outer race to rotate within the friction housing to provide braking resistance to unwinding rotation, and to disengage and freewheel when the reel or cover drum rotates in the winding direction, thereby, preventing excessive unwinding rotation of the cable reel and cover drum (if necessary) due to angular momentum (backlash) when being unwound, and preventing unwinding cable or cover rotation due to elasticity when being wound.

In a preferred version for swimming pools, the invented manually powered pool cover drive includes a pair of removable handles or lever arms adapted to alternately couple with a first pair of overrunning, one-way clutch mechanisms permanently journaled around a cover drum drive shaft, or a second pair of overrunning, one way clutch mechanisms permanently journaled around a cable reel drive shaft. The two extending removable handles enable alternating left and right power and return strokes at least doubling a rate of retraction and/or extension a pool cover back and forth across a swimming pool relative to a single handle system. The rates of cover extension and retraction rates can be further adjusted using conventional gear or chain and sprocket drive transmission systems coupling rotation of the respective drum and reel drive shafts to the cover drum and cable reel. Turning housings each containing an overrunning, one way clutch, journaled around the respective drive shafts each include a fitting or socket for receiving the distal end of the handle or lever. The turning housings are designed for passively orienting the coupling sockets generally upwards to facilitate the insertion of the handle ends. The axes of the coupling sockets of each pair of turning housings also incline at a slight angle with respect to each other in a plane parallel to the drive shafts for inherently providing separation between the gripping sections of the respective handles for right and left arm operation, a feature which eliminates torque tending to twist the handles in the sockets and radially loading the overrunning, one way clutch mechanism secured within the housing. In fact, such inclination allows round or tubular fitting sockets for receiving the distal ends of the handles or levers.

A unique feature of the preferred dual handle, overrunning clutch version of the invented drive is that the tendency of the cover drum or cable reel being wound to unwind during a return stoke due to inherent elasticity in the pool cover and cables is eliminated. In particular, one overrunning clutch mechanism rotating responsive to a power stroke engages and rotates a drive shaft for winding a cable or cover while simultaneously the other overrunning clutch mechanism rotating responsive to the return stroke disengages and freewheels oppositely relative to the drive shaft. Thus the drive shafts couple via the pair of overrunning, one way clutches to a pair of handles can only rotate in the winding direction so long as one handle is pushed or pulled in a power stroke or held stationary. The advantages provided by this latter feature are particularly apparent for larger pools where constraining walls of an enclosing cover drum housing, trough or trench limit the degree of rotation of a handle on a power stroke to that of attributable to the elastic unwinding response of the cables or covers being wound. (In such large pool cover systems, the elastic unwind response can be of such magnitude as to render passive braking resistance mechanisms in effective.)

Similarly, in European type buoyant slat pool cover systems (See U.S. Pat. No. 3,613,126, Granderath.) the preferred dual handle, overrunning, one way clutch version of the invented manual drive system inherently overcomes the passive forces of buoyancy or gravity tending to unwind a cover being wound. In addition, the length of the handles of the invented manual drive mechanism can be chosen to provide the necessary mechanical advantage for winding such buoyant slat pool covers which wind to diameters ranging between 2–3 feet in addition to countering buoyancy or gravity. To prevent unwinding of a wound buoyant slat cover, a short locking bar having a length only sufficient to be constrained from rotating by an enclosure wall, can be inserted into a handle socket of one of the turning housings to provide a positive stop preventing the cover from accidentally unwinding and closing. A simple friction brake on the cover drum axle would be sufficient to counteract the buoyant or gravitational forces and to enable to handles of the invented drive to be removed. Still another advantage of the invented manual drive for submerged buoyant slat pool cover systems over conventionally powered electrical driven systems is that expensive seals and the like typically required for isolating the electrical components (motors) from water are not necessary. With the invented manual drive, a simple and inexpensive chain and sprocket drive can be used to couple a drive shaft on the deck surface to a submerged cover drum axle.

For smaller pool and spa cover systems (typically installed below a deck) both the resistance to winding and the elastic unwinding response of the cables or covers are reduced because of the shorter length of the cables and smaller size of the cover. Accordingly, handle length may be shortened to eliminate some of the constraints imposed on rotation of the handle by the enclosure enabling a single handle manually powered drive utilizing the described passive brake mechanism on the cable reel to prevent cable unwinding backlash and tangling is typically adequate to preclude elastic unwind of the cable as it is being wound.

A primary advantage of the invented manually powered pool cover drive is that the cover drum and cable reel can be permanently located in a below deck pool cover bay at one end of the pool or spa. In particular, average human arm or leg extension/contraction translation ranges from 20 to 30 inches. At the end of a pivoting lever arm or handle 3 to 4 feet long, such translation converts to incremental rotations ranging from 25 to 40 degrees which are well within physical constraints restricting such rotation in a typical swimming pool cover bay or trench. Proportionately greater rotations are possible with shorter handles. (A handle extending out of an enclosure or a bay 2 feet wide pivoting around an centrally located axis located 2 feet below the top can be rotate through an angle of approximately 60 degrees between the constraining walls.)

The principal advantage of the invented manually powered pool cover drive is that the extending long handle(s) coupled to the overrunning clutch mechanism(s) enables a pool owner to operate the drive while standing or sitting on a deck surface in a natural posture suited for efficiently utilizing his or her physical body strength and weight for reciprocating the pivoting handle(s) back and forth in power and return strokes for rotating a drive shaft located proximate to or below a supporting deck surface.

Other important advantages of the invented manually powered pool cover drive relate to the magnitude of torque delivered by the overrunning clutches fitted or secured at the end of the extending pivoting handles for incrementally rotating the respective drive shafts. In fact, torque provided in so turning the drive shafts can exceed that provided by conventional electrical and hydraulic pool cover motors because of the mechanical advantage afforded by the long pivoting handles.

Other aspects of the invented manually powered drive for pool covers relate to selection of design features and properties of overrunning clutch mechanisms and drive shafts. In particular, it is desirable to minimize the degree of rotation required for 'wedging' and/or locking an outer race to a shaft responsive to rotation of the race relative to the shaft in one direction and for 'unwedging' and/or disengaging the outer race from the shaft responsive to rotation of the race relative to the shaft in the opposite direction.

Another particularly novel feature of the invented manually powered pool cover drive relates to the design of a passive, one-way braking element which includes an adjustable cylindrical compression or brake housing constraining rotation of an outer cylindrical race of a conventional overrunning clutch journaled around a shaft such that shaft rotation in one direction wedges coupling shaft rotation to the outer cylindrical race for braking while shaft rotation in the opposite direction unwedges de-coupling shaft rotation from the race allowing the shaft to freely rotate.

Another novel advantage provided by the invented pool cover drive is that a short locking bar can be inserted into overrunning, one way clutch housing on the drive shaft of the cable reel to prevent unwinding of the cable reel, and thereby be constrained to passively lock the pool cover in a closed position preventing access to the pool.

Still another aspect of the invented manually powered pool cover drive is that it can be utilized as a substitute or alternative drive in combination with existing electrically and hydraulically driven (automatic) pool cover systems by the simple expedient of adding suitable drive shafts extending from the opposite ends and sides of cover drums and cable reels respectively for use during power outages and motor breakdowns.

A primary benefit of the invented dual overrunning clutch manually powered pool cover drive system is that it is both considerably less complicated and considerably less expensive than automatic systems, yet accomplishes almost the same benefits.

Another benefit of the invented drive is that the cost of electric or hydraulic supply lines to the pool cover mechanism are eliminated. Furthermore, any hazard associated with electrical supply lines near the pool is eliminated.

Still other benefits derived from invented drive stem from the basic simplicity of the mechanism. The principles of operation are simple and easily comprehensible by most if not all pool owners. And, a pool owner manually operating the invented drive requiring his or her physical effort is more likely to investigate and correct the cause of a jam preventing cover extension or retraction rather than whipsawing the system into catastrophic failure by a switching the drive motor of an automatic system at location remote from the pool.

Aspects of the invented pool cover drive also relate to incorporation of suitable mechanical systems enabling a pool owner to utilize his or her legs and gravitational mass to reciprocate the lever, and overrunning clutch mechanism in a manner akin to that in well known stair tread exercise machines [See U.S. Pat. No. 5,139,469].

Another aspect of the invented manually powered pool cover drive system relates to incorporation of a momentum flywheel for smoothing rotation and maintaining cover and cable movement between power strokes such that friction resistance stays dynamic rather than intermittently static and dynamic.

A further benefit of the inverted pool cover drive system is that it can provide sufficient rotational torque enabling a pour over water removal screened port to be incorporated into the cover. [See Foster and Last, supra]

Finally, the invented overrunning clutch manually powered pool cover drive system has comparable advantages for winding large floating thermal blankets onto and off of movable cover reels.

Still other features, aspects, advantages and objects presented and accomplished by the invented manually powered pool cover drive system will become apparent and/or be more fully understood with reference to the following description and detailed drawings of preferred and exemplary embodiments.

DESCRIPTION OF THE DRAWINGS

FIGS. 2*a*–2*b* illustrate a manual powered pool cover system with a single long handle either integral with or connectable with a housed overrunning clutch mechanism which journals around a drive shaft for winding a pool cover around a cover drum during retraction thereof, or for rotating a cable reel for winding cables extending the cover.

FIGS. 6*a, b* & *c* illustrates the principles operation of conventional sprag type overrunning clutch mechanisms suitable for the invented manual powered pool cover drive.

FIGS. 10*a* & 10*b* illustrates the elements and operation of the passive, one-way braking unit incorporating either a conventional sprag or Torrington type roller overrunning, one way clutch mechanism.

DESCRIPTION OF PREFERRED AND EXEMPLARY EMBODIMENTS

Figures 1, 1A, 1B, 1C, 1D:
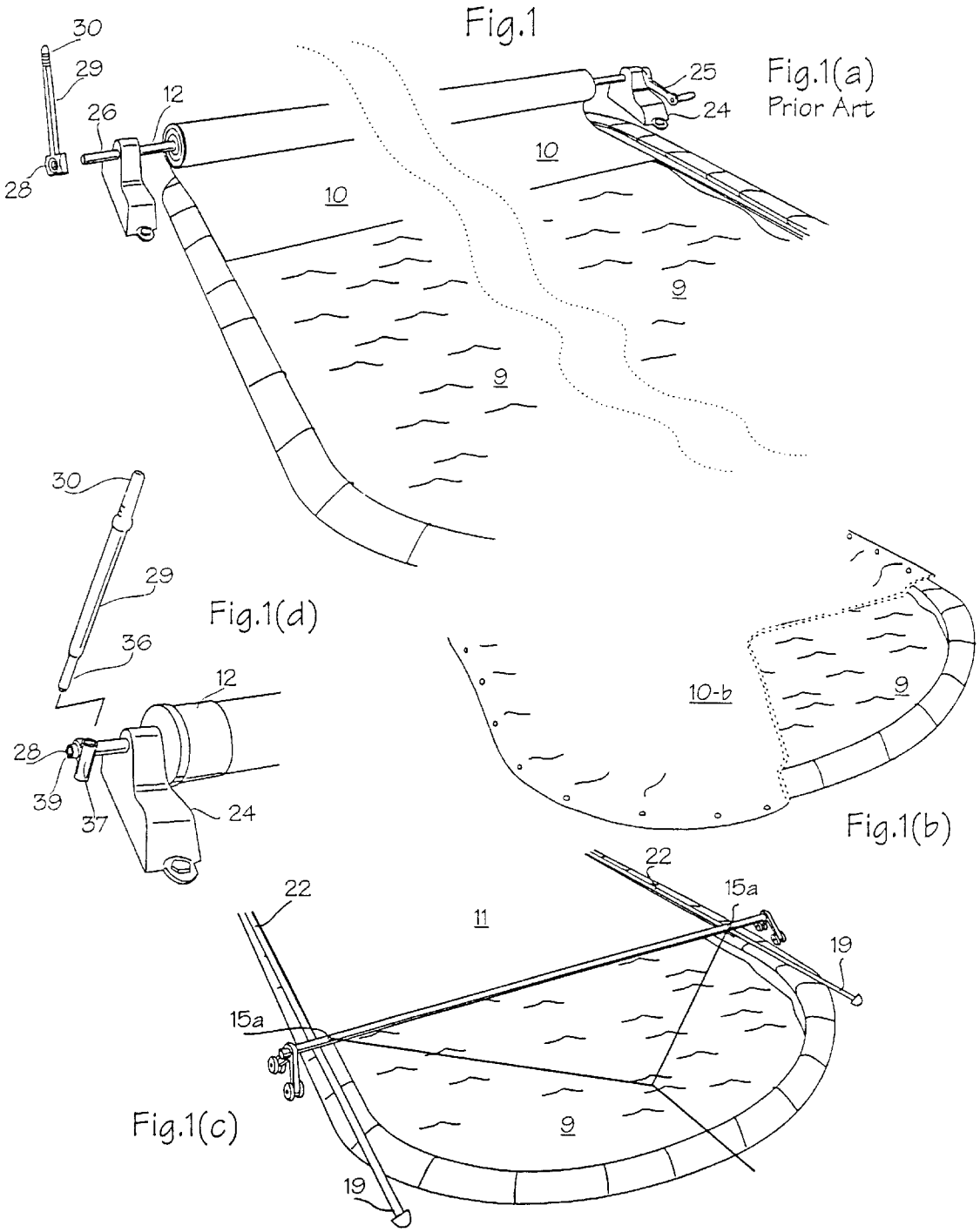
Fig.1(a) Prior Art
FIGS. 1*a*–1*d* illustrate a manual powered pool cover system with a single long handle either secured to or connectable to a housed overrunning clutch mechanism which journals around a drive shaft for winding a pool cover around a cover drum.

Looking at FIGS. 1*a–c,* the invented manually powered pool cover system includes a flexible floating pool cover 10, attached for winding around a cylindrical cover drum 12 supported for rotation between a pair of bearing blocks 24 at one end of a swimming pool 9. FIG. 1*b* illustrates a manual safety cover with fasteners around its perimeter. FIG. 1*c* shows a pool cover 11 with a rigid leading edge 15 secured to and supporting the front edge of the cover above the surface of the pool 9. Beaded tapes 22 sewn to the side edges of the pool cover 11 are captured and slide within "C" channels (not shown) of conventional swimming pool tracks 19 secured along either side of the pool. The pool cover 11 is extended across the pool using cables attached to the leading edge 15 or front corners 15*a* of the cover 11.

As shown in FIG. 1*a,* an overrunning, one-way clutch mechanism 28 is secured at the end of a long handle 29 three to five feet in length. The overrunning, one way clutch mechanism 28 is sized to journal around and engage a drive shaft 26 extending from and coupled to the cover drum 12. Alternatively, as shown in FIG. 1*d,* the distal end 36 of the long handle 29 is shaped for insertion into a cylindrical fitting or socket 37 welded to the exterior of a turning housing 39 containing an overrunning, one way clutch 28 journaled around and engaging the shaft 26. [See also FIGS. 5*b*–5*d*] As illustrated, the cover drum 12 may also be rotated by a conventional crank handle 25 turning a similar drive shaft 26 extending from the opposite end of the cover drum.

To operate the invented manual powered pool cover system shown in FIG. 1*a,* a pool owner manually slides the overrunning clutch mechanism 28 secured at the end of the long handle 39 onto the shaft 26 and pivots the handle 29 in a power stroke turning clutch 28 in a direction for engaging and rotating the shaft 26 to wind the cover 11 around the cover drum 12. The owner then pivots the handle 29 back in a return stroke in the opposite direction turning clutch 28 in the over running or freewheeling direction disengaged from the particular shaft 26. Alternatively, looking at FIG. 1*d,* the pool owner inserts the shaped distal end 36 of the handle 29 into the cylindrical fitting or socket 37 of the turning housing 39 and reciprocates the handle 29 back and forth in a power and a return stroke for winding the pool cover. There should be sufficient friction or other resistance to preclude unwinding rotation of the cover drum 12 being wound during the return stroke of the handle 29.

Should the pool owner inadvertently slide the overrunning clutch 28 onto the particular shaft 26 such that the clutch over runs in the winding direction (the power stroke), he or she simply slides the clutch 28 off the shaft, rotates it 180° and slides it back onto the particular shaft. The handle 29 must be removed to allow unwinding of the cover 10 from around the cover drum 12 for the extension of the cover across the pool. Alternatively handle 29 could be modified to telescope, slide-away or fold to allow complete rotation in the unwinding direction.

Looking now to FIGS. 2*a* & 2*b,* the invented manually powered pool cover drive includes a flexible pool cover 11, attached for winding around a cylindrical cover drum 12 supported for rotation between a pair of bearing blocks 24 at one end of a swimming pool 9. The front edge 13 of the cover 11 is supported by an essentially rigid leading edge 15 spanning the width of the pool above water level by a pair sliders 16 each sliding within a "C" channel of a conventional extruded Aluminum swimming pool track 19 secured along each side of the swimming pool 9. [Detailed descriptions of the sliders 16, the cooperating leading edge 15 and the various cover and cover drum features all suitable for incorporation into the invented manually powered pool cover drive are presented in Applicant's U.S. Pat. Nos. 4,939,798 and 5,067,184]

Cables 21, typically a DACRON® line, are incorporated into and form a beaded tape 22 sewn to the side edges of the cover 11. The cables 21 extend from the front corners of the cover 11, and are trained around pulleys 23 at the distal ends of the tracks 19, and return within the parallel return channels within the track 19 to ultimately connect through a system of pulleys 17 for and winding onto a cable take-up reel 18 also supported for rotation between a pair of bearing blocks 24 at the cover drum end of the pool 9. The beaded tapes 22 sewn to the side edges of the cover 11 are captured and slide within the "C" channels (not shown) of the tracks 19. The cover drum 12 and cable take-up reel 18 include shafts 26 and 27 respectively having the same diameter extending outward from an adjacent bearing block 24. The shaft 26 is integral with or operatively couples to rotate the cover drum 12, and shaft 27 is integral with or operatively couples to rotate the cable reel 18. Preferably the distal end 36 of the long handle 29 is shaped for insertion into a cylindrical fitting or socket 37 welded to the exterior of a turning housing 39 containing an overrunning, one way clutch 28 mechanism. [See also FIGS. 5*b*–5*d.*] Alternatively as shown in FIG. 2*b,* an overrunning clutch mechanism 28 sized to over run around and engage the respective extending shafts 26 or 27 is mounted at the end of a long handle 29 three to five feet in length.

A passive one-way brake unit 31 is journaled around the shaft 27 extending from the cable reel 18 and secured to the adjacent bearing block 24 for restraining unwinding rotation of the cable reel 18, thereby preventing cable snarling due to angular momentum over spinning the cable reel 18. [It should be noted that while a conventional braking system such as that described in U.S. Pat. No. 4,858,253 Lamb and others would accomplish the same result, namely keep the cable reel from backlashing, it brakes in the winding direction, increasing torque required to extend the cover]

To operate the invented manually powered pool cover drive shown in FIGS. 2*a* & 2*b,* a pool owner manually either slides the overrunning clutch mechanism 28 secured at the end of the long handle 29 onto either the shaft 26 or 27, or inserts the socket end 36 of the handle into the turning socket 37 of the turning housing 39 and reciprocates the handle 29 back and forth in a power and a return stroke for winding either the cables 21 or the pool cover 11. The passive one way braking unit 31 is adjusted to provide sufficient friction to preclude elastic unwinding rotation of the cable reel 18 when being wound during the return stroke of the handle 29. When winding the cover 11 around the cover drum 12, the friction resistance of the beaded tape edges 22 of the cover 11 sliding within the "C" channels of the swimming pool tracks 19 should be sufficient to offset elastic unwinding rotation of the cover drum 12 during the return stroke.

Figures 3, 3A, 3B, 3C, 3D:
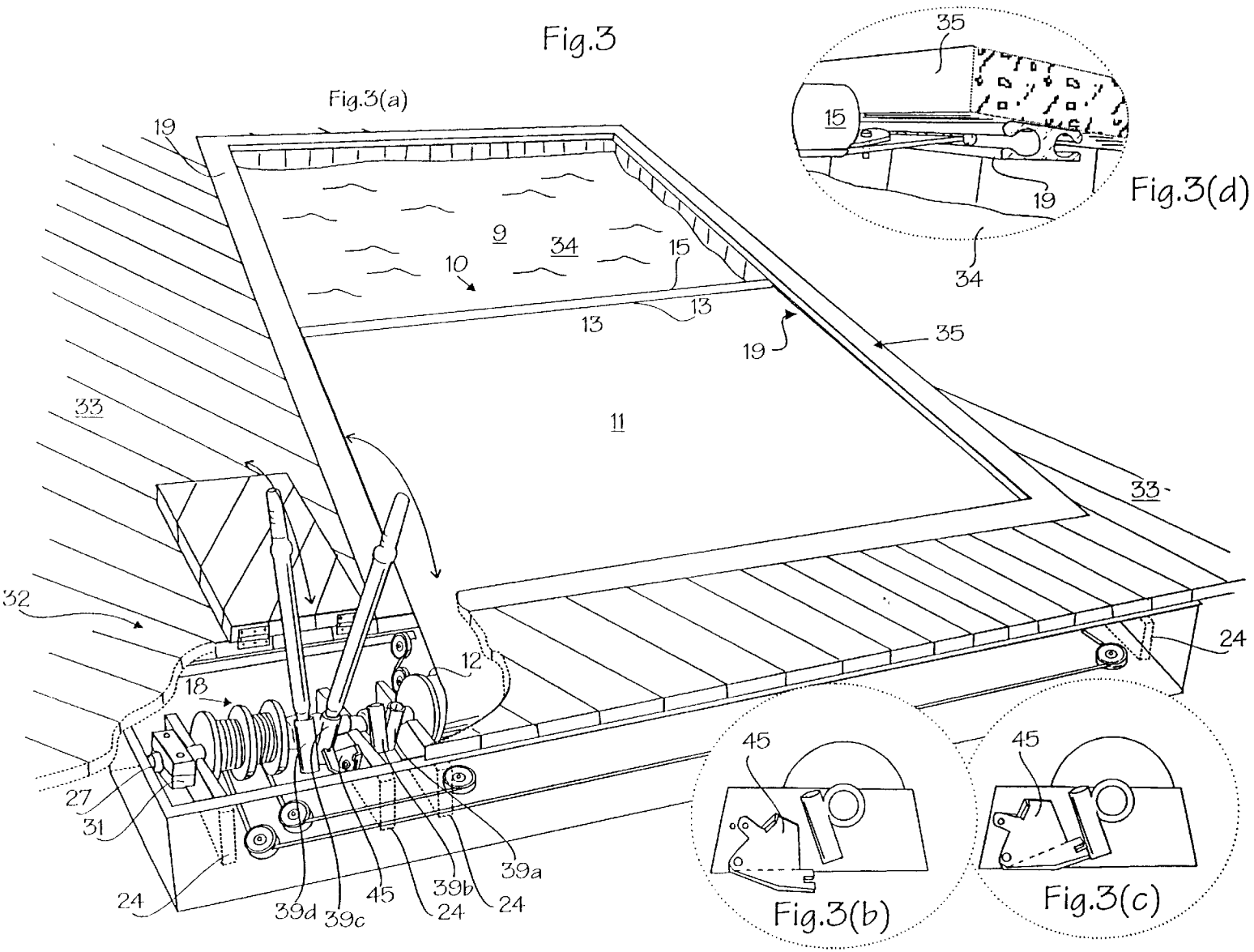
FIG. 3 illustrates a manual powered pool cover system located in a trench or bay at one end of a pool where the system is powered by a pair of removable long handles adapted to alternatively couple with two pairs of overrunning, one way clutch mechanisms, where one pair of the overrunning, one way clutch mechanisms is permanently journaled around a cover drum drive shaft, the other pair around a cable reel drive shaft.

Turning now to FIG. 3, the pool cover drive is located in a cable reel & cover drum bay 32 at one end of a pool 9 below the pool deck 33. In this instance, swimming pool tracks 19 are preferably located and secured to the underside of a coping 35 over hanging the surface of the pool water 34 on opposite sides of the pool 9. [See Applicant's U.S. Pat. No. 5,349,707 for illustrations and descriptions of pool cover systems located in bays at one end of a swimming pool where the anchoring swimming pool track are secure on an underneath surface of overhanging copings.] The drive shaft 26 is coupled for rotating the cover drum 12 and drive shaft 27 is coupled for rotating the cable reel 18. A pair of turning housings 39*a–b* & 39*c–d* each containing one or more overrunning, one way clutch mechanisms 28 are permanently journaled around each drive shaft 26 & 27. A pair of long handles 29 each having a socket end 36 shaped for insertion into a cylindrical fitting or socket 37 secured to the exterior of the turning housings 39.

To operate the cover drive shown in FIG. 3, the pool owner inserts the socket ends 36 of a pair of long handles 29 into the sockets 37 of either the pair of turning housings 39*a–b* or the pair 39*c–d* journaled around the respective drive shafts 26 or 27. Both the overrunning, one way clutches 28 of each pair of turning housings 39*a–b* or 39*c–d* are oriented to engage and overrun in the same direction. (In the instance where the overrunning clutches 28 are secured within turning housings permanently mounted at the distal ends of a pair handles 29, the pool owner simply slides or engages the clutches 28 at the ends of the two handles 29 on the particular drive shaft 26 or 27 for winding the cover 11 or the cable reel and cables 21.

The cover 11 and cables should both respectively attached to the cover drum 12 and cable reel 18 to wind up in the same direction preferable that which allows a pool owner, standing at the end, facing the pool 9, to alternately pull one handle 29 in power strokes engaging the shaft 26 or 27 for winding, while simultaneously pushing the other handle 29 oppositely in a freewheeling return stroke rotating the clutch 28 on the shaft 26 or 27 in the overrunning direction. Accordingly, the left overrunning clutch mechanism 28 engages and rotates the particular drive shaft 26 or 27 as the right overrunning clutch mechanism 28 disengages and rotates oppositely relative to the shaft, and visa versa. Since one clutch 28 and handle 29 engages and rotates the particular shaft 26 or 27 during a power stroke while the other clutch mechanism 28 disengages and rotates oppositely in the return stroke, it is not usually necessary to assure or provide resistance precluding unwinding of the element being wound during the return stroke.

But it is still necessary to passively brake unwinding rotation of the cable reel 18 when being unwound, otherwise, angular momentum imparted to the cable reel 18 upon winding the cover 11 causes the reel 18 to overspin unwinding more of the respective cables 21 from round the reel than is drawn into coupling pulley system 17 between the reel 18 and swimming pool tracks 19. Unless restrained, such excessively unwinding cables 21 backlash, i.e. loop larger than the constraining sides of the reel sheaves, flop over and tangle with each other and other components in the cable reel & cover drum bay 32. With continued winding of the cover such tangled cable loops tend to catch and tighten into a snarls jamming the system precluding further winding of the cover 11.

To a degree, angular momentum imparted to the cover drum 12 when winding the cables can also cause the drum to overspin unwinding more cover 11 than is drawn into the "C" channels of the swimming pool track 19. However, because vinyl fabric materials of typical pool covers 11 do have a degree of stiffness, such overspinning tends to initially loosen the wound layers of the cover 11 around the cover drum 12. Friction between the loosened layers of cover 11 then tends to damp out excessive overspin. However, as the linear distance between the track slider stop/guide (See U.S. Pat. No. 5,349,707, supra) and the tangent unwinding point of the cover increases during extension, there is an increased tendency of the unwinding cover to bend and back wind back around the drum in the unwinding direction (backlash). However, unlike the cables 21, because the cover 11 is more or less constrained by other components of the system to an aligned orientation, such back winding typically will not cause a jam.

Figure 4:
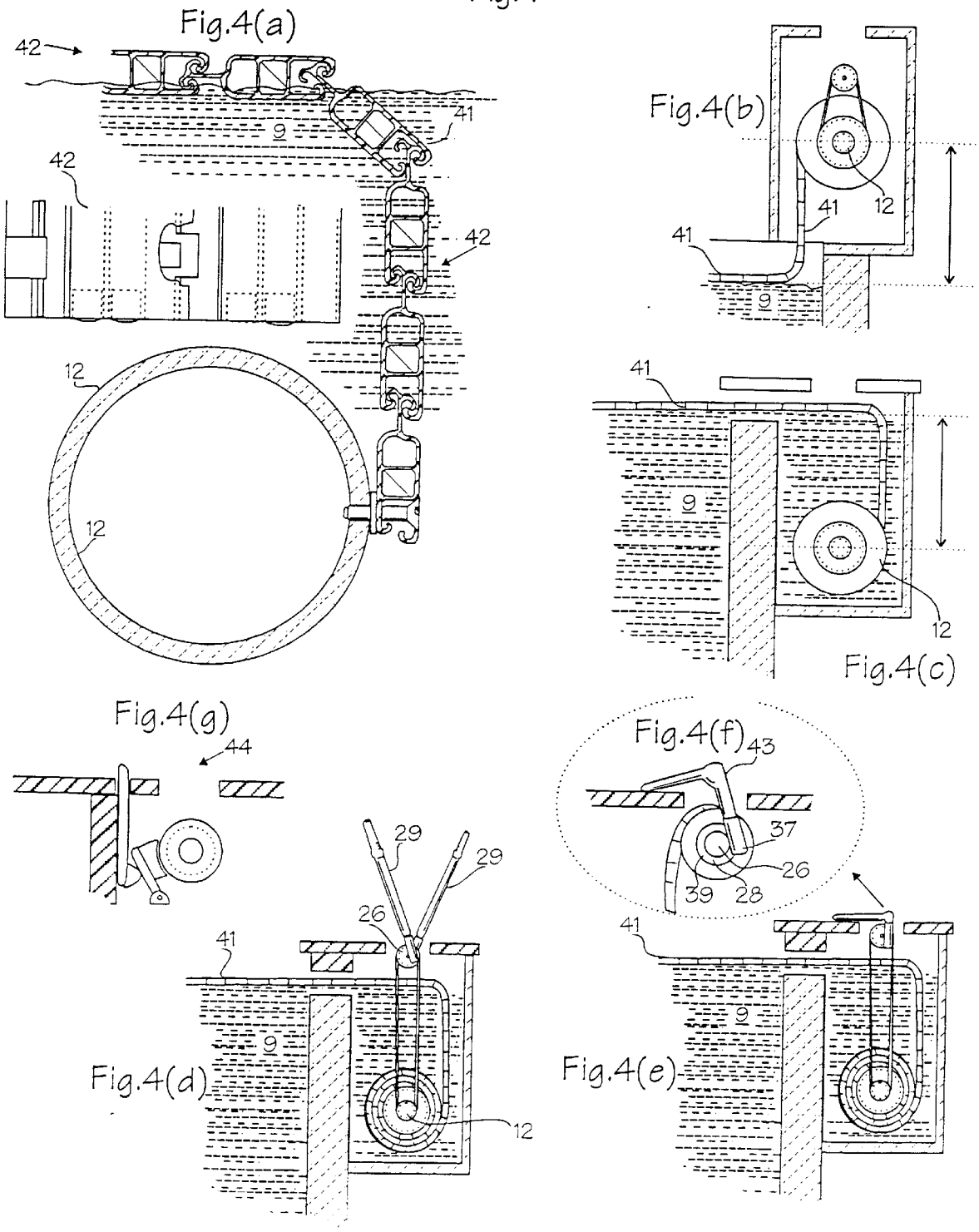
FIGS. 4*a*–4*g* illustrates details of incorporation of the invented manual powered pool cover drive into a buoyant slat-type floating cover.

FIG. 4*a* to 4*f* illustrate the application of the invented manual drive to the European buoyant slat floating cover systems. (See U.S. Pat. No. 3,613,125, R. Granderath ) FIG. 4*a* illustrates the typical slat foam filled buoyant membrane members 41 making up a pool cover 42 which extends across the pool 9 responsive to buoyancy forces of where the cover drum 12 is appropriately located beneath the pool surface. (FIGS. 4*c* & 4*d*) FIG. 4*b* illustrates a gravity feed alternative of a buoyant slat cover system where the cover drum 12 is located above the pool 9. FIGS. 4*e* & 4*a* illustrates the insertion of a locking short bar 43 in one of the sockets 37 on one of a pair of turning housings 39 enclosing an overrunning, one way clutch mechanism 28 to prevent the cover from passively unwinding and returning to the closed position responsive to buoyant or gravity forces. FIG. 4*g* schematically illustrates an conventional engageable friction brake mechanism 44 enabling an operator to temporarily brake the drum rotation while disengaging the handle(s) 29 from the socket(s) 37 of the turning housing(s) 39 of the invented drive. [The brake mechanism 44 can also be used to prevent the cover drum 12 from unwinding during the return stroke of a single handle winding drive system.]

There are many different ways overrunning clutches 28 can be secured or fitted at the ends of an associated long handle or lever 29. In its simplest form, as illustrated in FIG. 2*b,* the combination comprises a housing 39 welded at the end of a steel bar or black iron pipe handle 29. The housing 39 is bored perpendicularly with respect to handle 29 to secure or function as an exterior cylindrical raceway of a conventional overrunning clutch mechanism 28 such as a Sprag Clutch Mechanism manufactured by *Carlyle Johnson Machine Company* located in Manchester, Conn., (See FIG. 6*a–c*) or a *Torrington Type Drawn Cup Roller Clutch* assembly available from *The Torrington Company.* (See FIG. 7*a–e*) In essence, the handle or lever 29 is a long handled ratchet socket wrench where the turning housing 39 and the associated overrunning, one way clutch mechanism 28 secured at its distal end is a socket adapted to journal around, engage and turn a drive shaft 26 or 27.

In selecting dimensions and specifying tolerances for the housing 37 and components of the overrunning clutch mechanism 28 at the end of the lever 29, the careful designer should consider and appreciate the magnitude of the loads or forces including torques that can be imparted/transmitted to the respective components of the overrunning clutch by the long lever arm 29. For example, the mechanical advantage of 4 foot lever arm 29 turning a 6 inch diameter cover drum or cable reel is 24:1. It is recommended that the inner and outer engagement raceways of the overrunning clutch mechanisms 28 be composed of hardened steel or other materials of comparable properties. The sprags or rollers of such clutch mechanisms should be composed of ball bearing steel. Finally the engagement surfaces on the drive shafts 26 and 27 respectively coupled for rotating the cover drum 12 and cable reel 18 should also be composed of hardened steel materials.

Alternatively, as shown in FIG. 1*d* the handle 29 is a simple structural lever with a hand grip 30 at one end while the distal end 36 is shaped for insertion into the handle socket 37 of the turning housing 39. In designing and specifying the dimensions and the materials of the turning housing 39, handle sockets 37 and handles 29, the careful designer should consider and appreciate the magnitude of the load or forces including torques that are to be imparted/transmitted to the turning housings 39.

Figure 11:
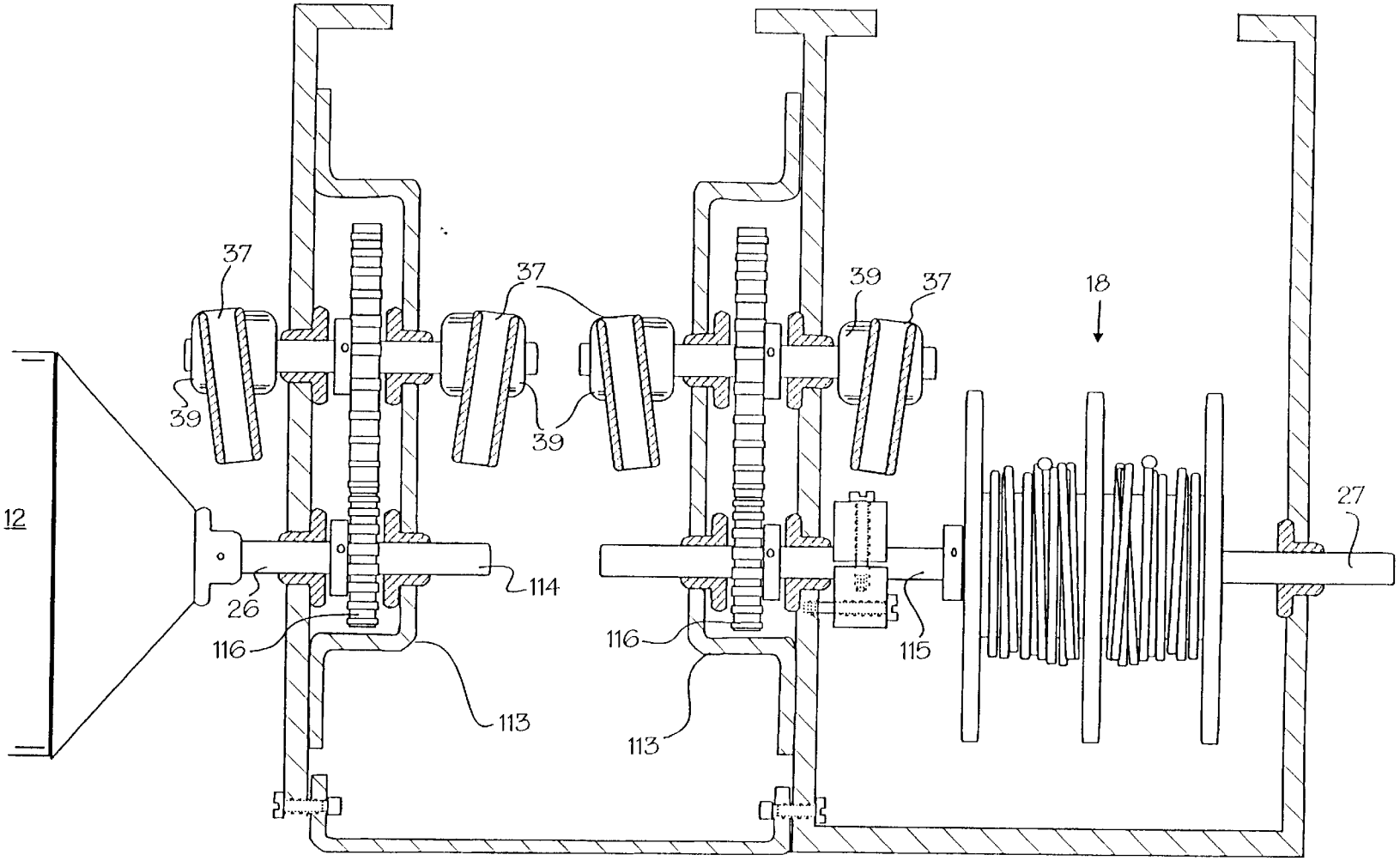
FIG. 11 illustrates the elements of a conventional gear/sprocket-chain drive transmission coupling rotation of a drive shaft to a cover drum and cable reel for multiplying the rate of rotation of the cover drum or cable reel relative to the drive shaft.

With reference to FIGS. 3, and 11, the engagement raceway 38 of four separate overrunning clutch mechanism 28*a*–28*d* (see FIG. 5*a–d,* 6*a–c,* 7*a–e,* 8, & 9) are each received and secured within turning housings 39*a–d.* Each turning housing 39 includes a handle socket 37 for receiving the distal or socket end of the long handle/lever 29. Two turning housings 39*a* & 39*b* and associated overrunning clutch mechanisms 28 are permanently journaled around the drive shaft 26 coupled for rotating the cover drum 12, and two housings 39*c* & 39*d* and associated overrunning clutch mechanisms 28 are permanently journaled around the drive shaft 27 coupled for rotating the cable reel 18. The turning housings 39*a–d* can be biased to maintain a particular orientation on the particular shafts 26 and 27, preferably slightly off vertical towards an operator standing above the cover drum & cable reel bay 32 inserting the distal end of the handle into the socket 37.

Figures 5, 5A, 5B, 5C, 5D:
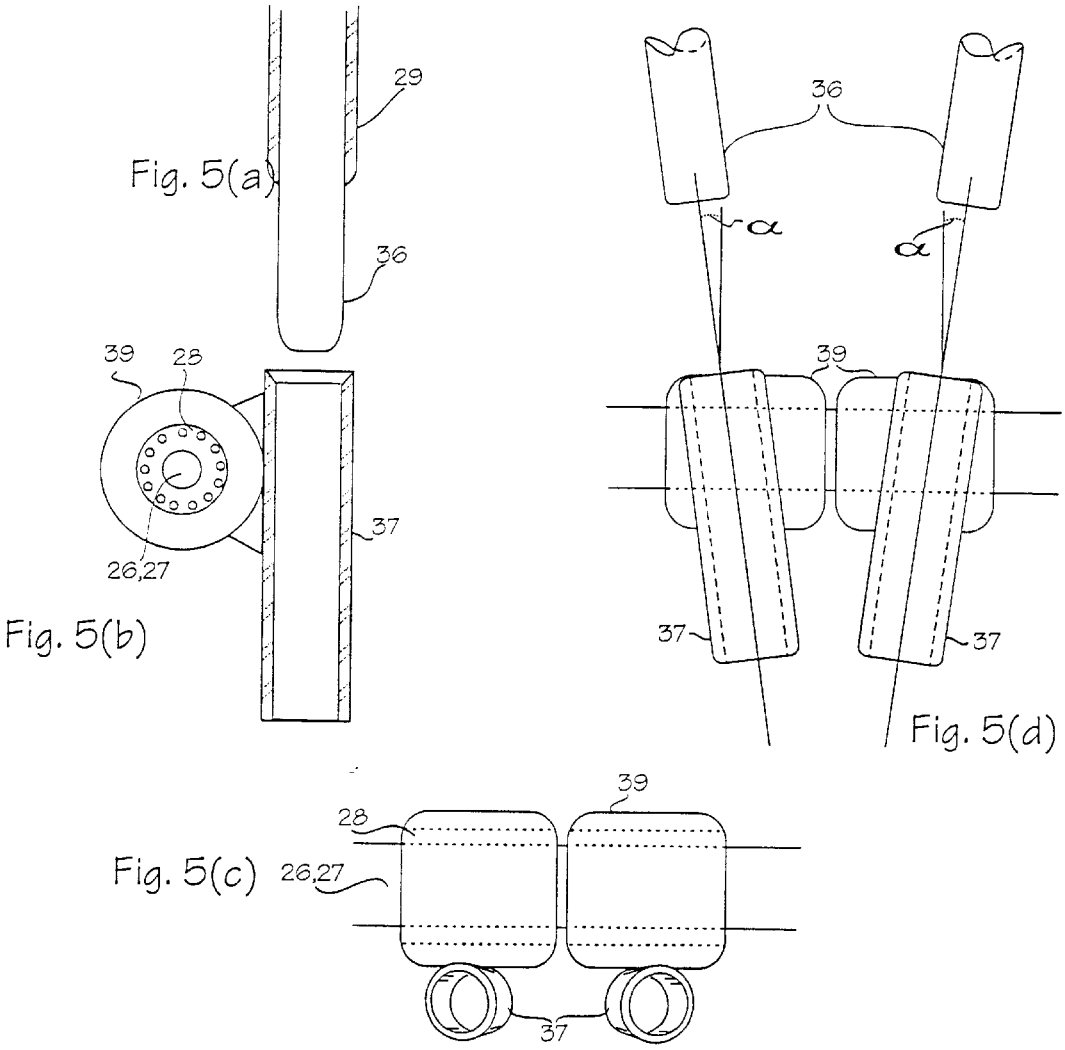
FIGS. 5*a*–5*d* illustrate details of the coupling between the handle and the turning housings containing overrunning, one-way, clutch mechanisms.
Figure 7:
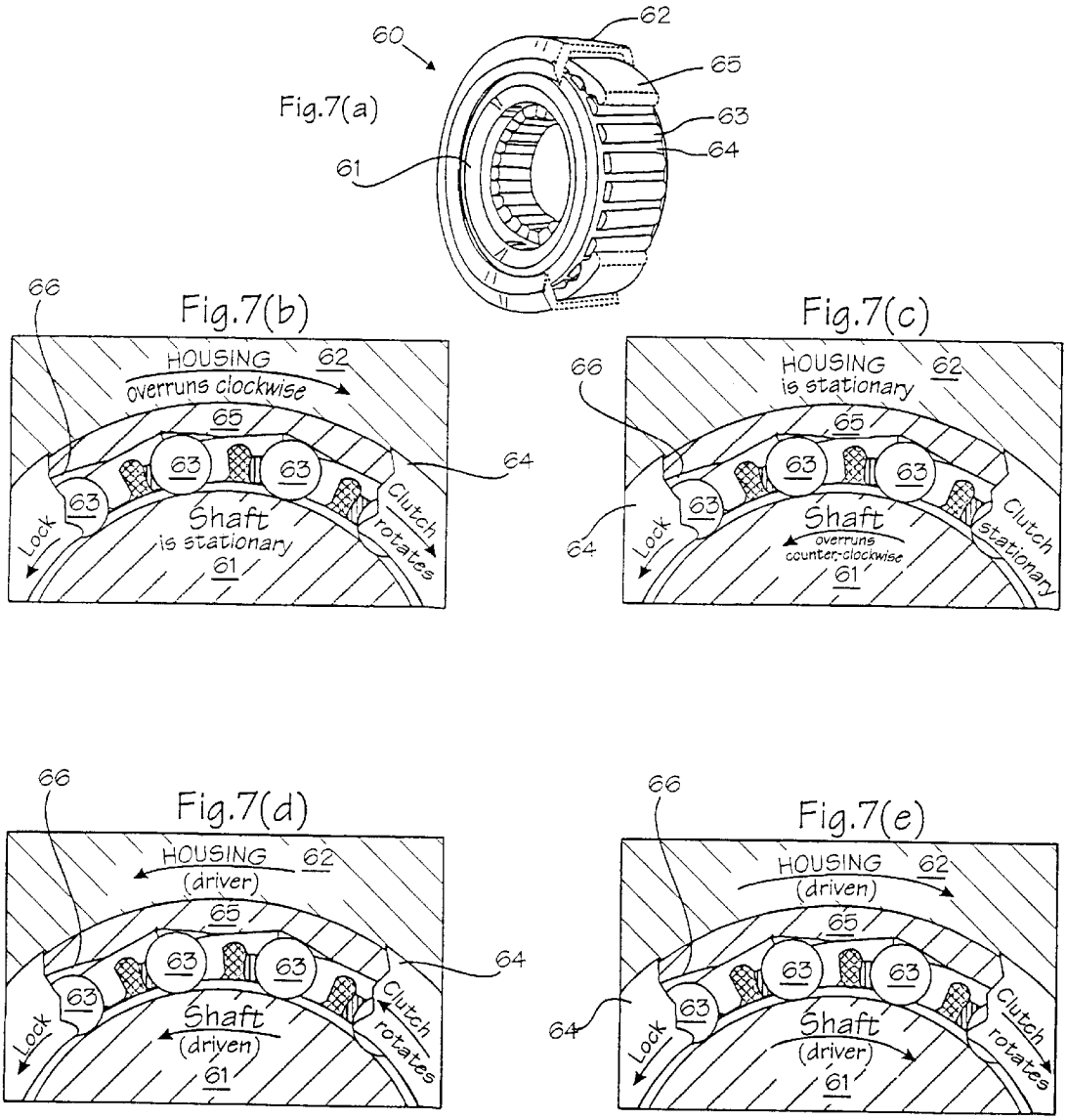
Fig.7 Prior Art
FIGS. 7*a*–7*e* illustrate the principles of operation of a conventional Torrington type roller clutch mechanism preferred for the invented manual powered pool cover drive.

In more detail, as illustrated in FIG. 5*b,* gravity can be passively utilized to maintain a desired orientation by designing the entire assembly (turning housings 39, clutches 28 and associated handle sockets 37) with an off axis centers of mass such that gravity and angular momentum assures a desired (vertical) orientation of the sockets 37 in a plane perpendicular to the axis of the particular drive shaft 26/27 (FIG. 5*b,* 5*c*). Then, as illustrated in FIG. 5*d* the sockets 37 of each pair of turning housings 39 are preferably inclined or tilted at a slight angle with respect to each other in a plane parallel to the particular drive shaft 26/27 such that the inserted handles 29 diverge to provide a comfortable separation between the pair of handles at the point where the handles are manually gripped for reciprocation back and forth in a power and a return stroke. The careful designer should recognize that inclining the sockets 37 in the manner described above eliminates torque tending to twist the handles 29 in the sockets 37. [Such twisting torque would be present if the handles 29 were bent in an offset to provide lateral separation between the extending handles at the grips 30. And, in such a case, the socket ends 36 of the handles 29 and the sockets 37 would have to include cooperating lands to prevent twisting rotation of the handles 29 in the sockets 37. This twisting torque would also axial load the overrunning, one way clutches 28 requiring a more expensive clutch bearing combination to counteract such handle torque.]

FIGS. 6*a–c,* illustrate the elements and operational principals of a conventional sprag type overrunning clutch 50. Sprag overrunning clutches 50 typically includes a sprag cage 51 for maintaining orientation of a plurality of sprags 52 concentricity between an outer cylindrical engagement raceway 53 and an inner cylindrical engagement raceway 54. The inner engagement raceway typically comprises the surface of a shaft 56, e.g., in the invented manual pool cover drive, the drive shafts 26 or 27. As indicated by the arrows in FIG. 6*b,* relative rotation between the respective inner and outer raceways 53 & 54 in one direction rotates the sprags 52 into wedging engagement between the respective raceways coupling the rotation of one raceway to the other raceway. Relative rotation of the respective raceways 53 & 54 in the opposite direction as indicated by the arrow in FIG. 4*c* rotates the sprags out of engagement with the respective raceways de-coupling rotation of the raceways allowing the outer race way to overrun. Such sprag type overrunning clutch mechanisms may also include ball and or needle bearings confined by the sprag cage 51 to facilitate overrunning rotation of the respective raceways 53 & 54.

Looking now at FIGS. 7*a–7e,* a Torrington type roller clutch 60 transmits torque between a shaft 61 and a housing 62 in one direction and allows free overrun in the opposite direction. The elements of such clutch mechanisms 60 include cylindrical roller or needle bearings 63 typically received within a bearing cage 64 and constrained to rotate between an exterior cylindrical raceway 65 presenting precisely formed interior ramp surfaces 66 and a cylindrical surface of a shaft 61. Typically, the raceway 65 is press fit into the housing 62. When the shaft 61 and housing 62 are relatively rotated in the wedging direction as indicated by the arrows in FIGS. 7*c* & 7*d,* the interior ramp surfaces 66 of the raceway 65 cause the rollers 63 to wedge, positively locking the shaft 61 to raceway 65 and housing 62. Conversely, the needle bearings 63 roll freely when the shaft 61 and housing 62 are relatively rotated oppositely as indicated by the arrows in FIGS. 7*a* & 7*b.* When necessary more than one of these clutches may be press fit into a housing in order to increase the torque capacity.

Figure 8:
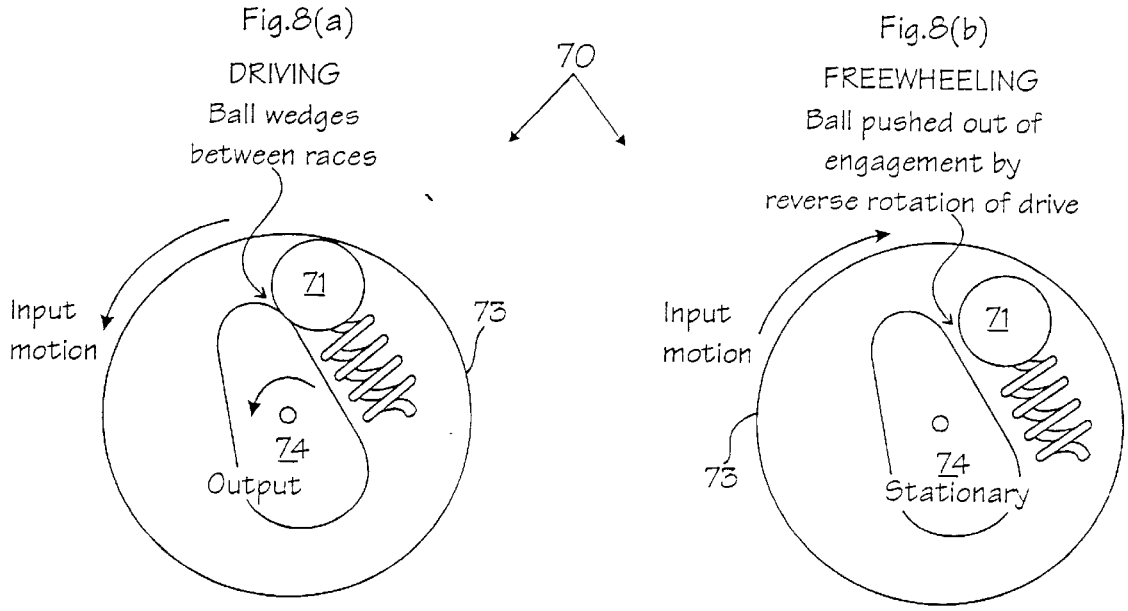
Fig.8 Prior Art
FIGS. 8*a* & 8*b* illustrate principles of operation of another conventional overrunning, one way clutch mechanism suitable for the invented manual powered pool cover drive.

FIGS. 8*a–b* illustrate the elements and the operational principles of a conventional overrunning crank 70 where a ball 71 is biased with a spring 72 to wedge between the inner surface of a cylindrical race 73 and the exterior surface of an oblong or lobed shaft 74. When wedged, the ball 71 couples rotation of the race 73 and the lobed shaft 74 (FIG. 8*a*) However, when race 73 rotates with respect to the lobed shaft in the other direction the ball 71 is pushed out of engagement and the race 73 and shaft 74 freewheel with respect to each other.

Figure 9:
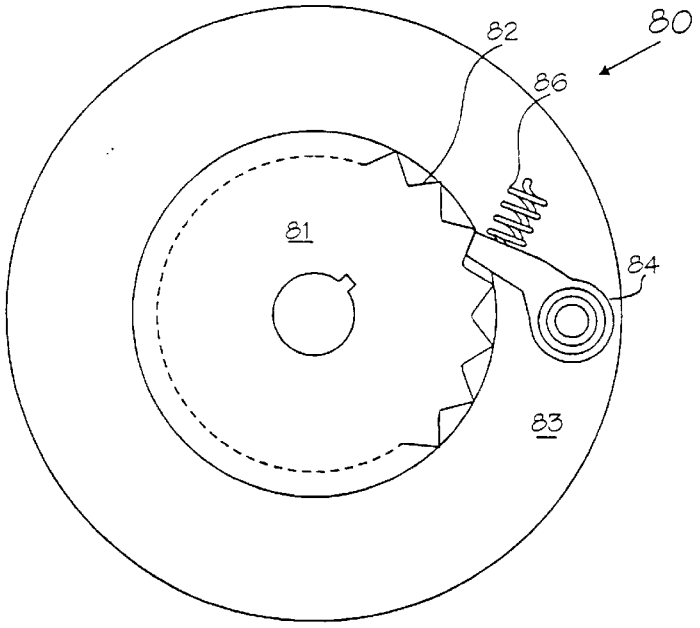
Fig.9 Prior Art
FIG. 9 illustrates the principals of operation of a ratcheting, overrunning one way clutch mechanism suitable for the invented manual powered pool cover drive.

FIG. 9 illustrates the elements and the operational principles of a conventional ratchet 80 where the shaft 81 includes a saw-tooth exterior surface 82, and the outer housing 83 includes one or more pivoting dogs 84 oriented and biased by a spring 86 to engage the toothed surface 82 for coupling rotation of the housing 83 to the shaft 81 in one direction while allowing the shaft 81 and housing to rotate with respect to each other in the opposite direction. With such ratcheting overrunning clutches [typically used in ratchet socket wrenches and like] engagement is not instantaneous in the locking direction and therefore the efficiency is not as good as say the Torrington roller ramp clutches which engage almost instantaneously.

FIG. 10 illustrates the elements and operational principles of a simple passive, one-way, braking mechanism 100 utilizing conventional overrunning clutch mechanisms. In particular, a split cylindrical, compression, friction bushing 104 is provided by two braking blocks 102*a–b,* each having a concave hemi-cylindrical bushing surface 103 positioned for defining a cylindrical bushing sized for sandwiching the exterior raceway 106 of a conventional overrunning, one-way clutch mechanism 107, preferably a Torrington Type Roller Clutch assembly available from The Torrington Company, a division of Ingersol Rand. Braking block 102*a* is bolted to a bearing frame 24 supporting a rotating (drive) shaft 26/27 while braking block 102*b* is fastened to block 102*a* by a pair of conventional bolts 108. Accordingly, the braking housing 100 is held stationary and the degree of friction resisting rotation of the exterior raceway or housing 106 of the overrunning clutch mechanism 107 rotating within the split cylindrical compression bushing 104 can be adjusted using the conventional bolts 108. The overrunning, one-way clutch mechanism 107 is journaled around a shaft 26/27 to allow the shaft to freewheel when rotating in the winding direction and to engage, coupling shaft rotation to the exterior raceway or housing 106 when rotating in an unwinding direction.

The astute mechanical designer should recognize that the described passive, one-way, braking mechanism 100 will not only prevent backlash caused by angular momentum, over-spinning the cable reel or sheet drum from which a cable or sheet is being unwound, but also will prevent unwinding rotation of a cable reel or sheet drum around which a cable or sheet is being wound induced by elastic recoil of the a cable or sheet material which stretches as it is being wound.

However, it should also be recognized that angular momentum inherent in the rotating winding element whether cable reel 18 or cover drum 12 has a beneficial effect of 'smoothing' extension and retraction of the pool cover of the invented manual powered pool cover drive. In particular, static friction [friction between stationary components] is generally greater than dynamic friction [friction between moving components]. Accordingly, it is desirable to maintain a dynamic sliding status of the beaded pool cover edges 22 and sliders 16 sliding in the anchoring swimming pool track 19, once rotation of a winding element has been initiated for extension or retraction of the pool cover 11. Where the winding components [cover drum and cover or cable reel and cable] do not inherently provide sufficient rotational inertia to maintain continued rotation of the reel or drum between power strokes [as for example, in a single handle system] a momentum flywheel can be coupled to rotate with a particular drive shaft for, or reel or drum to supply such inertia. In particular, looking to FIG. 2*a,* a momentum flywheel can be coupled to rotate with the cover drum 12 and drive shaft 26 and with the cable reel 18 and drive shaft 27.

Referring now to the side view shown in FIG. 1, the rate of rotation of a cable reel 18 and cover drum 12 relative to rotation of a drive shaft 26/27 can be multiplied by a simple gear or sprocket and chain transmission system 112 which includes a hexahedral bearing frame 113 supporting one end of a cover drum shaft 114 extending from and turning with a cover drum 12 and cable reel shaft 115 extending from and turning with a cable reel 18. Gear or chain sprockets 116 are coupled to the respective shafts 114 and 115 within the bearing frame 113. Also, while shaft 114 turning with the cover drum 12 is preferentially just an axial extension of the cover drum, it is not necessary to orient the cable reels 18 and associated shaft 115 along the same axial line. In fact, there may be advantages in orienting the cable reels 18 and associated shaft 115 along an entirely different axial line. [Remember, a human being most efficiently delivers power by pulling with arms and upper torso while simultaneously pushing with legs and lower torso.] And, in most cases, the transmission system 112 will be located at a end of the pool in the same bay as the cover drum. Accordingly, before fastening the cables and cover to oppositely wind, which requires power strokes in opposite directions, it should determined whether there is enough space between the pool end and the axle 122 to stand and comfortably and pull on the handles 29.]

Whether designing a transmission system 112, or a system directly rotating a shaft coupled to the cover drum or cable real, the careful designer should realize that the turning housings 39*a–d* and associated sockets 37 coupling to the handles 29 will rotate with the drive shafts 26 & 27 when the particular shaft rotates in the unwinding direction. Accordingly, the hexahedral frame which supports the respective drive shafts and shafts for rotation should allow sufficient space between shafts, axles and walls to accommodate the rotating turning housings 39*a–d* and sockets 37.

In fact, because the turning housing 39 and associated overrunning, one-way clutch 28 engage and rotate with the drive shaft when rotated in the unwinding direction provides a means for locking the cover in a closed or open position by inserting a short locking bar FIGS. 4*e* & 4*f*)) into the coupling socket 37 of one turning housings 39 winding the cable reel 18 or cover drum respectively. The locking bar need only have sufficient length to prevent the particular turning housing 39 from rotating in the hexahedral bearing frame.

The invented manually powered pool cover drive has been described in context of both representative and preferred embodiments which have reference to automatic swimming pool cover systems invented and developed by the Applicant and others. It should be recognized that skilled engineers and designers can specify different mechanical components for manually powered pool cover drives which perform substantially the same function, in substantially the same way to achieve substantially the same result as those components described and specified above for the invented manually powered pool cover drive. For example, there are many different types of overrunning, one way clutch mechanisms which coupe relative rotation of two concentric elements in one rotational direction yet allow the elements to freewheel or overrun for relative rotation in the opposite rotational direction. Accordingly, while mechanical components suitable for incorporation into the invented manually powered pool cover drive are not exactly described herein, they will fall within the spirit and the scope of invention as described and set forth in the appended claims.

I claim:

1. A manual cover drive assembly for manually retracting and rotating a flexible cover about a cover drum, said cover drive assembly comprising:

a) a cover drum supported for rotation relative to a covered surface for receiving the cover in a winding operation;

b) a drive shaft coupled to the cover drum for rotating the cover drum in a winding direction to enable winding of the cover onto the drum during winding rotation thereof;

c) at least one long lever to provide sufficient mechanical advantage for winding the cover about the drum during winding rotation thereof;

d) an overrunning one way clutch mechanism overrunning around the shaft and being engagable with the shaft for rotating in the winding direction but being automatically disengagable from the shaft when rotating in the unwinding direction and where the rotational speed of the shaft can exceed the rotational speed of the clutch; and e) means for releasably securing the long lever to the overrunning one way clutch to provide sufficient mechanical advantage for winding the cover onto the drum during movement of the long lever in a power stroke responsive to human limb movement.

2. The manual cover drive assembly of claim 1 wherein said overrunning one way clutch mechanism is comprised of a race and rotatable means with the rotatable means capable of being selectively engagable with the drive shaft when rotating in a winding direction and disengagable when rotating in an unwinding direction.

3. The manual cover drive assembly of claim 1 wherein passive brake means is operatively associated with said drive shaft for allowing the shaft to freewheel when rotating in a winding direction and causing a braking action when rotating in an unwinding direction.

4. The manual cover drive assembly of claim 3 wherein said passive brake means is comprised of:

1) An overrunning one way braking clutch located with respect to the drive shaft;

2) an outer race forming part of said overrunning braking clutch and overrnning the drum shaft and selectively engaging with and rotating with the drive shaft; and 3) a friction bushing member selectively engaged with a portion of the outer race to impart a breaking action to the outer race.

5. The manual cover drive assembly of claim 2 wherein said cover drum is located in closely spaced relationship to a surface on which the cover is to be used.

6. The manual cover drive assembly of claim 2 wherein said overrunning one way clutch mechanism includes means for releasably coupling the overrunning one way clutch mechanism to one end of said lever and which comprises, in combination:

a) a turning housing enclosing and securing an outer race of said overrunning one way clutch mechanism; and b) a tangential socket integral with the turning housing shaped to receive a distal end of said lever.

7. The manual cover drive assembly of claim 6 wherein each overrunning one way clutch mechanism and housing therefor has a center of gravity for passively orienting the tangential socket when the race of the clutch mechanism is overrunning around the clutch mechanism is overrunning around the drive shaft at a rotational position relative to a surface which is to receive the cover for insertion of the distal end of the lever.

8. The manual cover drive assembly of claim 7 wherein said lever has a longitudinal axis and said tangential socket has an axis where the longitudinal axis of the lever is oriented coaxial with the axis of the tangential socket when the distal end of the lever is inserted into and received by the socket, and wherein the center of gravity of said overrunning one way clutch mechanism passively orients the axis of the socket relative to the surface in a generally vertical direction.

9. A manual cover drive assembly for manually retracting and rotating a flexible cover about a cover drum, said cover drive assembly comprising:

a) a cover drum supported for rotation relative to a covered surface for receiving the cover in a winding operation;

b) a drive shaft coupled to the cover drum for rotating the cover drum in a winding direction to enable winding of the cover onto the drum during winding rotation thereof;

c) a pair of separate long lever handles to provide sufficient mechanical advantage for winding the cover about the drum during winding rotation of the drum;

d) a pair of separate individual overrunning one way clutch mechanisms overrunning around the shaft and being engagable with the shaft for rotating in the winding direction but disengagable from the shaft when rotating in the unwinding direction, each of said clutch mechanisms being located in close proximity to one another and in close proximity to one end of said drum shaft; and e) means for releasably securing each separate long lever handle individually to one of the overrunning one way clutch mechanisms to provide sufficient mechanical advantage for winding the cover on the drum during movement with long lever handles in a power stroke responsive to human limb movement.

10. The manual cover drive assembly of claim 9 wherein passive brake means and a separate clutch means is operatively associated with each one of said one way clutch mechanisms for allowing the shaft to freewheel when rotating in a winding direction and causing a braking action when rotating in an unwinding direction.

11. The manual cover drive assembly of claim 9 wherein each of said overrunning one way clutch mechanisms is comprised of a race and a rotatable means with the rotatable means capable of being selectively engagable with the drive shaft when rotating in a winding direction and disengagable when rotating in an unwinding direction.

12. The manual cover drive assembly of claim 11 wherein each said overrunning one way clutch mechanism is further comprised of:

1) said race being an outer race rotating about and overrunning the drive shaft and selectively engaging with and rotating with the drive shaft; and 2) a friction bushing member selectively engaged with a portion of the outer race to impart a braking action to the outer race.

13. The manual cover drive assembly of claim 9 wherein said cover drum is located in closely spaced relationship to a surface on which the cover is to be used.

14. The manual cover drive assembly of claim 9 where each said overrunning one way clutch mechanism includes means for releasably coupling each overrunning one way clutch mechanism to one end of a separate one of said levers which comprises, in combination:

a) a turning housing enclosing and securing an outer race of said overrunning one way clutch mechanism; and b) a tangential socket integral with the turning housing shaped to receive a distal end of said lever.

15. A manual cover drive for winding a cover around a cover drum for retracting a cover comprising, in combination:

a) a drive shaft coupled for rotating the cover drum in a winding direction to wind the cover around the cover drum, the cover drum being supported for rotation relative to a deck surface;

b) an overrunning one way clutch mechanism having a connecting means for slipping onto and off the drive shaft and for overrunning around and engaging the drive shaft to rotate same; and c) a long lever handle having a length extending from the connecting means of the one way clutch mechanism at its distal end providing sufficient mechanical advantage for winding the cover around the cover drum upon being reciprocated back and forth in an indexing power stroke and return stroke responsive to human limb movement when the one way clutch mechanism at the distal end of the long lever handle is slipped onto the shaft for overrunning around and engaging the drive shaft for rotation of same.

16. The manual cover drive of claim 15 where said overrunning one way clutch mechanism overruns around the shaft and engagable with the shaft for rotating in the winding direction.

17. The manual cover drive of claim 16 wherein said overrunning one way clutch mechanism is comprised of a race and a rotatable means with the rotatable means capable of being selectively engagable with the drive shaft when rotating in a winding direction and disengagable when rotating in an unwinding direction.

18. The manual cover drive of claim 15 wherein said long lever handle extends upwardly from said clutch mechanism to a height which allows a user to stand and engage the long lever handle to shift same back and forth in a power stroke.

19. The manual cover drive of claim 18 wherein said long lever handle has a length from about three to four feet.

20. The manual cover drive of claim 18 wherein said cover drum and drive shaft are mounted in a position below the covered surface.

21. A manual cover drive for winding a cover around a cover drum for retracting a cover comprising, in combination:

a) a drive shaft coupled for rotating the cover drum in a winding direction to wind the cover around the cover drum, the cover drum being supported for rotation relative to a deck surface;

b) a pair of overrunning one way clutch mechanisms with each having a connecting means for slipping onto and off the drive shaft and for overrunning around and engaging the drive shaft to rotate same, said clutch mechanisms being located in close proximity relative to one another relative to the length of the drive shaft; and c) a pair of long lever handles with each having a length extending from the connecting means of the one way clutch mechanism at its distal end providing sufficient mechanical advantage for winding the cover around the cover drum upon being reciprocated back and forth in a power stroke and a return stroke responsive to human limb movement when the one way clutch mechanisms at the distal ends of the pair of long lever handles are slipped onto the shaft for overrunning around and engaging the drive shaft for rotation of same.

22. The manual cover drive of claim 21 wherein each of said overrunning one way clutch mechanisms overrun around the shaft for rotating in the winding directing but are disengagable from the shaft when rotating in the unwinding direction.

23. The manual cover drive of claim 21 wherein each of said overrunning one way clutch mechanisms is comprised of a race and a rotatable means with the rotatable means capable of being selectively engagable with the drive shaft when rotating in a winding direction and disengagable when rotating in an unwinding direction.

24. The manual cover drive in claim 21 wherein each said long lever handle extends upwardly from the region where they connect to the clutch mechanism to a height which allows a user to stand and engage the long lever handles to shift same back and forth in reciprocative power strokes.

25. A manual cover drive assembly for manually retracting and rotating a flexible cover about a cover drum through manual reciprocation of a lever handle, said cover drum assembly comprising:

a) a cover drum supported for rotation relative to a covered surface for receiving the cover in a winding operation;

b) a drive shaft coupled to the cover drum for rotating the cover drum in a winding direction to enable winding of the cover onto the drum during a winding rotation of the cover drum;

c) at least one long lever handle to provide sufficient mechanical advantage for winding the cover about the drum during winding rotation of the cover drum; and d) mechanical coupling means for connecting the long lever handle to the drive shaft so that portions of a reciprocative back and forth movement of the lever handle responsive to human limb movement will be converted from reciprocative motion to rotational motion and cause the drive shaft and the cover drum to rotate in a winding direction to thereby wind the cover onto the drum.

26. The manual cover drive assembly in claim 25 wherein said mechanical coupling means comprises an overrunning one way clutch mechanism overrunning around the shaft and being engagable with the shaft for rotating in the winding direction but disengagable from the shaft when rotating in the unwinding direction.

27. The manual cover drive assembly in claim 26 wherein said mechanical coupling means also comprise means for releasably securing the long lever handle to the overrunning one way clutch to provide a substantial mechanical advantage for winding the cover onto the drum during a movement of the long lever handle in a power stoke responsive to human limb movement.

28. The manual cover drive assembly in claim 26 wherein said overrunning one way clutch mechanism is comprised of a race and a rotatable means with the rotatable means capable of being selectively engagable with the drive shaft when rotating in a winding direction and disengagable when rotating in an unwinding direction.

29. The manual cover drive assembly in claim 25 wherein said long lever handle extends upwardly from said mechanical coupling means to a height which allows a user to stand and engage the long lever handle to shift same back and forth in a power stroke.

30. The manual cover drive assembly in claim 29 wherein said long lever handle has a length from about three to four feet.

31. The manual cover drive assembly in claim 29 wherein said cover drum and drive shaft are mounted in a position below the covered surface.

32. The manual cover drive assembly in claim 25 wherein said assembly comprises a pair of separate lever handles and a pair of separate and individually operable mechanical coupling means with a separate lever handle being coupled to each one of said mechanical coupling means.

33. A manual cover drive assembly for manually retracting and rotating a flexible cover about a cover drum, said cover drive assembly comprising:

a) a cover drum supported for rotation relative to a covered surface for receiving the cover in a winding operation;

b) a drive shaft coupled to the cover drum for rotating the cover drum in a winding direction to enable winding of the cover onto the drum during winding rotation thereof;

c) at least one long lever to provide sufficient mechanical advantage for winding the cover about the drum during winding rotation thereof;

d) an overrunning one way clutch mechanism overrunning around the shaft and being engagable with the shaft for rotating in the winding direction but disengagable from the shaft when rotating in the unwinding direction;

e) passive brake means operating in conjunction with said one way clutch mechanism for allowing the shaft to freewheel when rotating in a winding direction and causing a braking action when rotating in an unwinding direction; and f) means for releasably securing the long lever to the overrunning one way clutch to provide sufficient mechanical advantage for winding the cover on the drum during a movement of the long lever in a power stroke responsive to human limb movement.

34. The manual cover drive assembly in claim 33 wherein said overrunning one way clutch mechanism is comprised of a race and rotatable means and the clutch mechanism being selectively engagable with the drive shaft when rotating in a winding direction and disengagable when rotating in an unwinding direction, and said passive brake means comprises a pair of braking blocks with bushing surfaces engagable with a race on an overrunning braking clutch.

35. A manual drive assembly for manually retracting and rotating a flexible and coilible cable extending from the front edge of a flexible cover about a cable reel; said drive assembly comprising:

a) a cable reel supported for rotation relative to a covered surface for receiving a cable in a winding operation;

b) a drive shaft coupled to the cable reel for rotating the cable reel in a winding direction to enable winding of the cable onto the reel during winding rotation thereof;

c) at least one long lever to provide sufficient mechanical advantage for winding the cable about the reel during winding rotation thereof;

d) an overrunning one way clutch mechanism overrunning around the shaft and being engagable with the shaft for rotating in the winding direction but disengagable from the shaft when the rotational speed of the clutch exceeds the rotational speed of the shaft when rotating in the winding direction; and e) means for releasably securing the long lever to the overrunning one way clutch to provide sufficient mechanical advantage for winding the cable onto the reel during a movement of the lever in a power stroke responsive to human limb movement.

36. The manual cover drive assembly of claim 35 wherein passive brake means operates in conjunction with said one way clutch mechanism for allowing the shaft to freewheel when rotating in a winding directing and causing a braking action when rotating in an unwinding direction.

37. The manual drive assembly in claim 35 wherein said overrunning one way clutch mechanism is comprised of a race and rotatable means with the rotatable means capable of being selectively engagable with the drive shaft when rotating in a winding direction and disengagable when rotating in an unwinding direction.

38. The manual cover drive assembly of claim 37 wherein said overrunning one way clutch mechanism is further comprised of:

1) said race is an outer race rotating about the drive shaft and selectively engaging with and rotating with the drive shaft; and 2) a friction bushing member selectively engaged with a portion of the outer race to impart a braking action to the outer race.

39. The manual drive assembly of claim 36 wherein said overrunning one way clutch mechanism includes means for releasably coupling the overrunning one way clutch mechanism to one end of said lever and which comprises:

a) a turning housing enclosing and securing an outer race of said overrunning one way clutch mechanism; and b) a tangential socket integral with the turning housing shaped to receive a distal end of said lever.

40. The manual drive assembly of claim 39 wherein each outer race and overrunning one way clutch mechanism and housing has an outer race and a center of gravity for passively orienting the tangential socket when journaled and overrunning around the drive shaft at a rotational position relative to the surface for insertion of the distal end of the lever.

41. A manual cover drive assembly for manually retracting and applying a flexible cover over a deck surface, said cover drive assembly comprising:

a) a cover drum and drive shaft located beneath a deck surface allowing an unspooling of the cover from the drum to the surface for extension over the deck surface;

b) an elongate drive handle removably connectable to said drive shaft and extending from said drive shaft outwardly and above the deck surface for engagement by a limb of a user of the drive assembly; and c) means for removably connecting the drive handle to the drive shaft.

* * * * *